US006062980A

United States Patent [19]

Luciano

[11] Patent Number: 6,062,980

[45] Date of Patent: May 16, 2000

[54] METHOD OF PLAYING A MULTI-STAGE WAGERING GAME

[76] Inventor: Robert A. Luciano, 4665 Lakewood Ct., Reno, Nev. 89509

[21] Appl. No.: 08/858,226

[22] Filed: May 19, 1997

[51] Int. Cl.[7] ..... A63B 15/00

[52] U.S. Cl. ..... 463/20; 273/143 R; 273/138.2

[58] Field of Search ..... 463/20, 21, 22, 463/16–19; 273/143 R, 138.1, 138.2, 138.3, 138 A

[56] References Cited

U.S. PATENT DOCUMENTS

| | | | |
|---|---|---|---|
| 4,695,053 | 9/1987 | Vazquez, Jr. et al. . | |
| 5,074,559 | 12/1991 | Okada | 273/143 R |
| 5,188,363 | 2/1993 | Marnell, II et al. . | |
| 5,332,219 | 7/1994 | Marnell, II et al. . | |
| 5,542,669 | 8/1996 | Charron et al. . | |
| 5,570,885 | 11/1996 | Ornstein . | |
| 5,775,692 | 7/1998 | Watts et al. | 273/143 R |
| 5,823,874 | 10/1998 | Adams . | |
| 5,848,932 | 12/1998 | Adams . | |

FOREIGN PATENT DOCUMENTS 2201821 9/1998 United Kingdom .

OTHER PUBLICATIONS

Sigma Game, Inc., "Treasure Tunnel Bonus Poker", website printout.

Sigma Game, Inc., "Treasure Tunnel Bonus Poker", product announcment from an unknown magazine.

Boomtown Hotel Casino Reno, "Treaure Tunnel", website printout.

*Primary Examiner*—Jessica J. Harrison
*Assistant Examiner*—Shelia Clayton
*Attorney, Agent, or Firm*—Ian F. Burns

[57] ABSTRACT

A method of playing a multi-stage wagering game is disclosed in which two random outputs may be generated. The outputs may be generated simultaneously or consecutively, and the second may be dependent upon the first output. If the first output is a predefined first-stage winning output, a first-stage prize may be awarded. If the second output is a predefined second-stage prize winning output, a second-stage prize may be awarded. If both the first and second outputs are prize winning outputs, a third-stage prize may be awarded. If a combination or partial combination of both the first and second outputs is a prize winning output, another third-stage prize may be awarded.

22 Claims, 4 Drawing Sheets

INITIATE GAME
120
GENERATE 1ST RANDOM OUTPUT
124
126
122
AWARD PRIZE
YES
IS 1ST OUTPUT A PRIZE WINNING OUTPUT?
127
NO
125
HAS AN ENABLING EVENT OCCURRED?
NO
YES
GENERATE 2ND RANDOM OUTPUT
130
136
132
AWARD PRIZE
YES
IS 2ND OUTPUT A 2ND STAGE PRIZE WINNING OUTPUT?
NO
128
134
NO
138
140
ARE BOTH OUTPUTS PRIZE WINNING OUTPUTS?
YES
YES
IS A COMBINATION OF BOTH OUTPUTS A PRIZE WINNING OUTPUT?
AWARD PRIZE
142
NO
NO
END
144

METHOD OF PLAYING A MULTI-STAGE WAGERING GAME

BACKGROUND OF THE INVENTION

1. Field of Invention

The present invention relates to a method for playing a multi-stage wagering game in which two or more random outcomes may be generated, independently or dependently, and a prize may be awarded if each outcome or a combination of the outcomes is a predefined prize winning outcome.

2. Description of Related Art

In the field of wagering games, it is often desirable to provide jackpots or prizes with high values. Large prizes tend to attract more players and the players tend to play longer because the anticipation and excitement of winning a large prize is very attractive. Casinos or game operators also benefit by increasing income and profit. However, when offering prizes with high values, it is important to ensure that the event which qualifies for a prize has a low probability of occurrence. If the probability of occurrence is relatively high, the prize will be awarded too frequently and the game operator will not profit from the game.

In some games it is difficult or impossible to provide large prizes because the underlying game cannot produce low probability events or outputs. What has long been needed is a method by which games which do not have low probability events can be adapted or modified to produce low probability outcomes without significantly changing the rules or methods of the underlying game. If a low probability outcome can be designed into these games, they may be used to award large prizes.

SUMMARY OF INVENTION

1. Objects of the Invention

It is a principal object of the present invention to provide a wagering game which uses two or more randomly generated outputs to determine if a prize will be awarded.

It is a further object of the present invention to provide the wagering game described above wherein a prize may be awarded for each randomly generated output.

It is another object of the present invention to provide the wagering game discussed above in which a combination or partial combination of the first and second outputs is used to determine if a prize will be awarded.

It is a further object of the present invention to provide a wagering game which is capable of awarding large prizes which have a low probability of occurrence.

It is yet a further object of the present invention to provide a game method which may be used to adapt games or devices which cannot produce low probability outputs so that the game can offer large prizes.

It is another object of the present invention to provide a wagering game which is capable of producing low probability events by combining two or more high probability events within the same game or within successive games.

These and other objects of the present invention may be realized by reference to the remaining portions of the specification, claims, and abstract.

2. Brief Description of the Invention

The present invention comprises a method in which two or more random outputs are generated. Any means or method which provides sufficiently random outcomes may generate the random outputs. The random outputs may be simultaneously generated or they may be consecutively generated and the second random output may be dependent upon the first random output. For example, the first random output may be required to achieve a certain result in order to trigger or enable the second random output generation. A player or user of the game may be required to trigger or enable the second random output generation.

Once the first random output is generated, it may be examined to determine if it is a pre-defined prize winning output. If it is, a first-stage prize may be awarded. A similar inquiry may be performed on the second random output to determine if a second-stage prize will be awarded. The examination of the outputs and the awarding of prizes are performed in a manner which is well known in the art.

Once the first and second outputs are generated, both outputs are examined to detenmine if a third-stage prize will be awarded. If both outputs are winning outputs, a third-stage prize may be awarded. A combination or a partial combination of the first and second outputs may also be examined to award a third-stage prize. For example, if part of both the first and second outputs are a pre-determined prize winning combination, a prize may be awarded.

It is recognized that the sequence of the random output generation and the inquiries may be changed and still achieve the objects of the present invention. The present invention may be played on many different kinds of game platforms, such as electronic gaming devices or table games.

The above description sets forth rather broadly the more important features of the present invention so that the detailed description that follows may be better understood and the contributions to the art may be appreciated. There are, of course, additional features of the invention which will be described which would form the subject matter of the claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Figure 1:
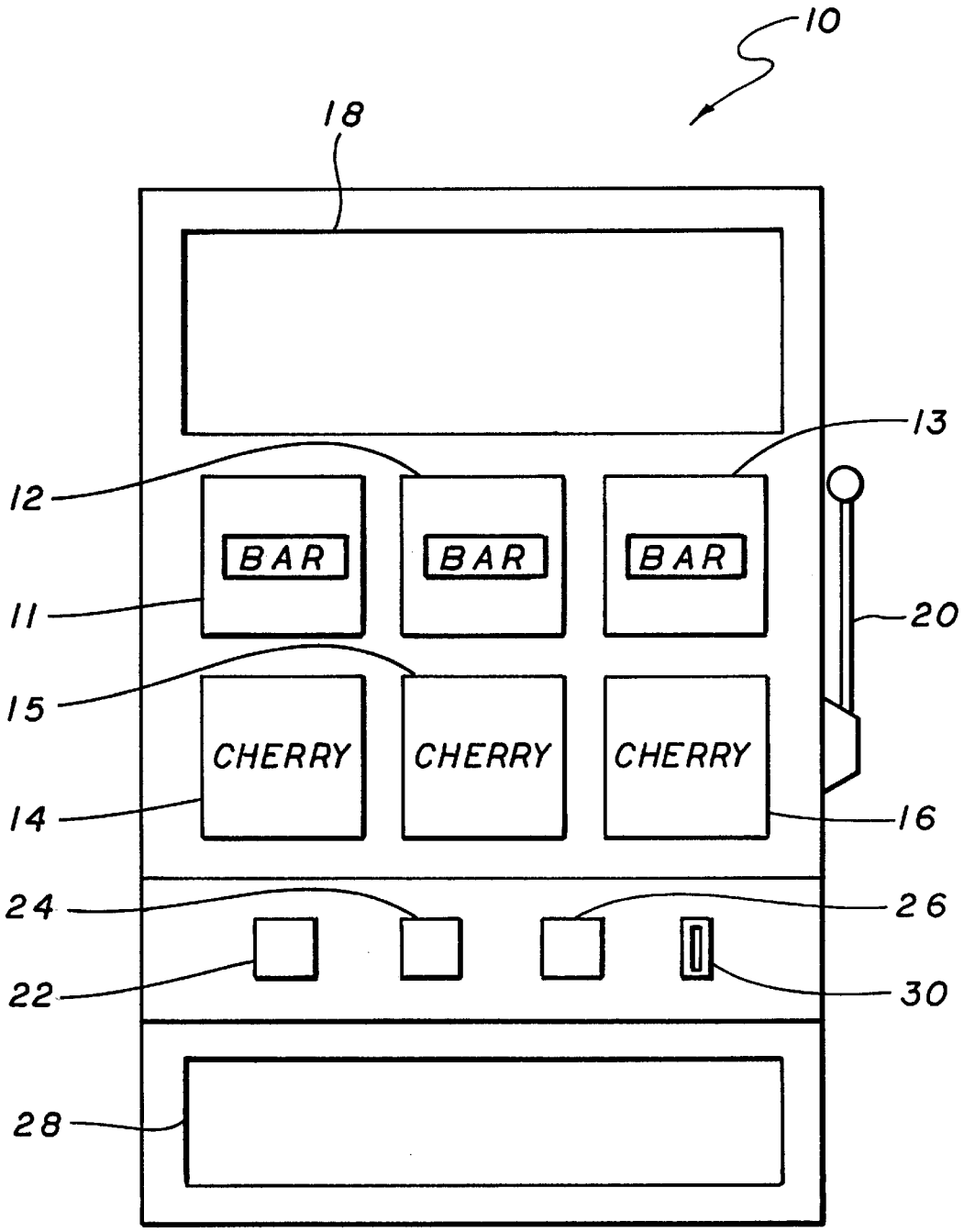
FIG. 1 is a schematic diagram of an electronic game device which may use the methods of the present invention.

FIG. 1 presents an example of an electronic gaming device which may utilize the present invention. This device, commonly called a slot machine, may be mounted on stands or in a counter top. A gaming device 10 has at least one display device for displaying randomly generated outputs. The embodiment disclosed in FIG. 1 utilizes six physical spinning reels 11–16 as display devices. Many other display devices, such as a video screen, could be used to display the outputs. The display device can also present the outputs in different formats, such as numbers or cards.

Device 10 also includes panels 18 and 28 which may include instructions and information, such as pay tables, for users. A handle 20 may be provided for activating device 10. Buttons 22, 24, and 26 may also be used for activating device 10 and for enabling the second and third stages of the game. A slot 30 is provided for accepting coins from the player. A bill acceptor and a player tracking card reader may also be used to input credits.

The embodiment disclosed in FIG. 1 utilizes two sets of three spinning reels. The first set of reels 11–13 represent the first-stage output while the second set of reels 14–6 represent the second-stage output. However, it is recognized that different combinations of reels can make up the first and second stage outputs. Device 10 independently generates two random outcomes which are displayed on the two sets of reels. The outcomes may be generated in any of the numerous ways which are known in the art. For example, each reel's stop positions may be tabulated in a micro processor in a one-to-one relationship with stop positions. The stop positions are selected by generating a random number and comparing the number to the table. The sequences of the output generation and display are determined by the methods of the present invention. The various methods of the present invention may be easily programmed into most modern micro processor-based gaming devices.

Simultaneous Independent Output Generation

Figure 2:
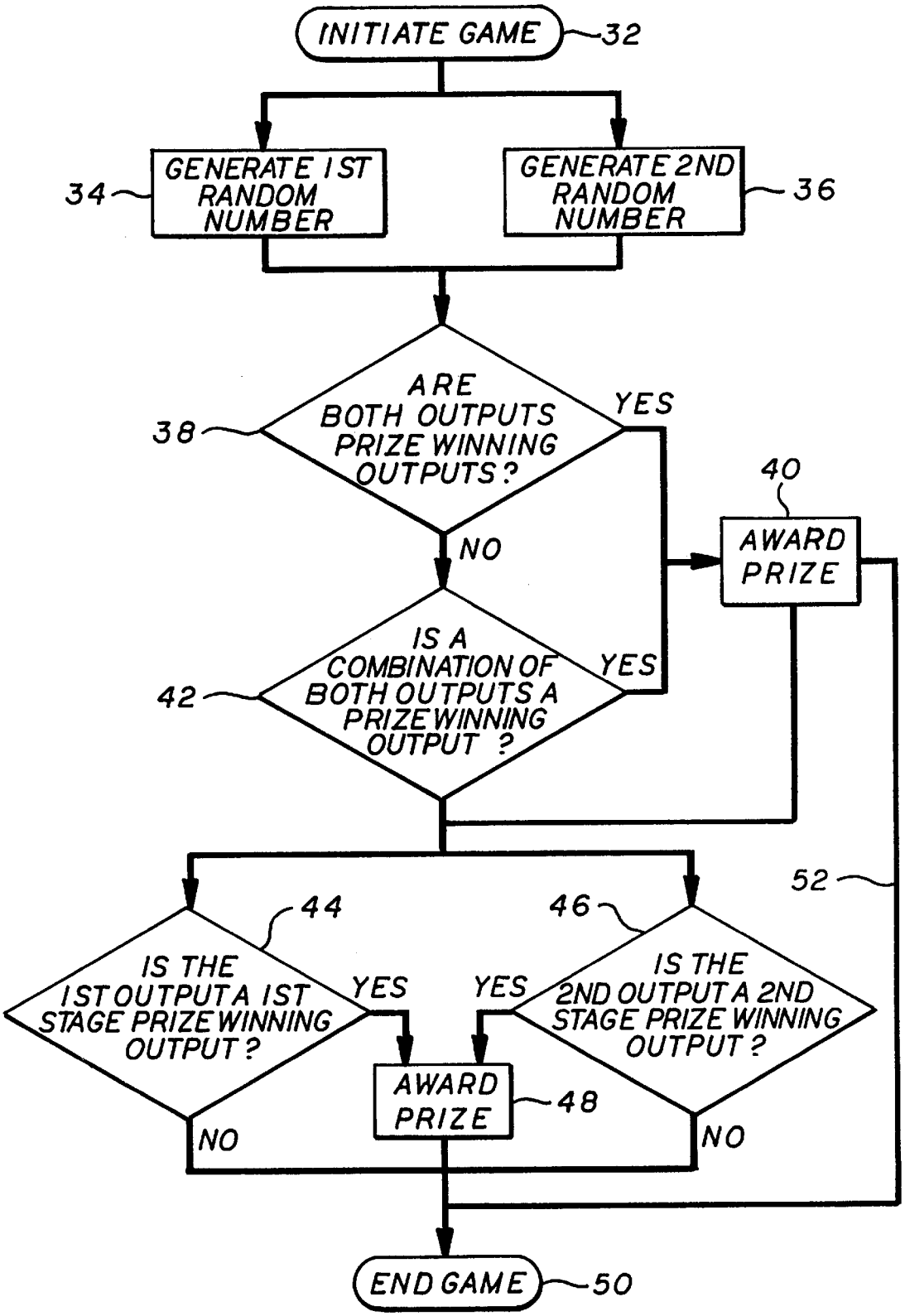
FIG. 2 is a flow chart of one embodiment of the present invention which simultaneously and independently generates the first and second random outputs.

As seen in FIG. 2, the first embodiment of the present invention is initiated 32 and the first random output 34 and second random output 36 are simultaneously (or nearly simultaneously) and independently generated. After the first and second random outputs are generated, the outputs are examined to determine if both of the outputs are prize winning outputs 38. If both outputs are prize winning outputs a prize is awarded 40. The prize may be cash, tokens, goods, or services. If both outputs are not prize winning outputs, a combination of the outputs may be examined to determine if the combination is a prize winning output 42. In reel-type slot machines, for example, the first and second reels of the first output may be combined with the first and second reels of the second output to form a combination output. If the combination is a prize winning output, a prize may be awarded 40. In the preferred embodiment, the value of the prize awarded is inversely proportional to the probability of occurrence of the winning output.

If the combination is not a prize winning output, then the first output may be examined to determine if it is a first-stage prize winning output 44. If the first output is a winning output, a prize may be awarded 48. The second output may simultaneously be examined to determine if it is a second-stage prize winning output 46. If the second output is a winning output, a prize may be awarded 48. If the first and second outputs are not winning outputs, no prize would be awarded and the game would end 50.

Line 52 represents an alternative embodiment in which the game would end once a prize was awarded. In this embodiment, the first and second outputs would not be individually examined to determine if they qualified for a prize.

It may be noted that both outputs 38 and the combination of the outputs 42 are examined in series. However, the steps may be arranged in parallel so that a positive evaluation in the first inquiry would not bypass the second inquiry. In the embodiment in FIG. 2, the first and second individual outputs 44 and 46 are examined in parallel so that each inquiry may lead to a prize award. It is also possible to arrange the inquiries in series so that the second inquiry could be bypassed in the event of a positive conclusion. That is, if the first output is a winning output, the second output would not be examined.

It may be seen from the above description that the probability of awarding a third-stage prize 40 is low even though the first and second random output generators may be incapable of generating low probability outputs. By requiring both outputs to be prize winning outputs 38 or by requiring a combination of the outputs to be a prize winning outputs 42, the probability of a positive result is lower than the random output generators may be capable of producing independently.

Consecutive Independent Output Generation

Figure 3:
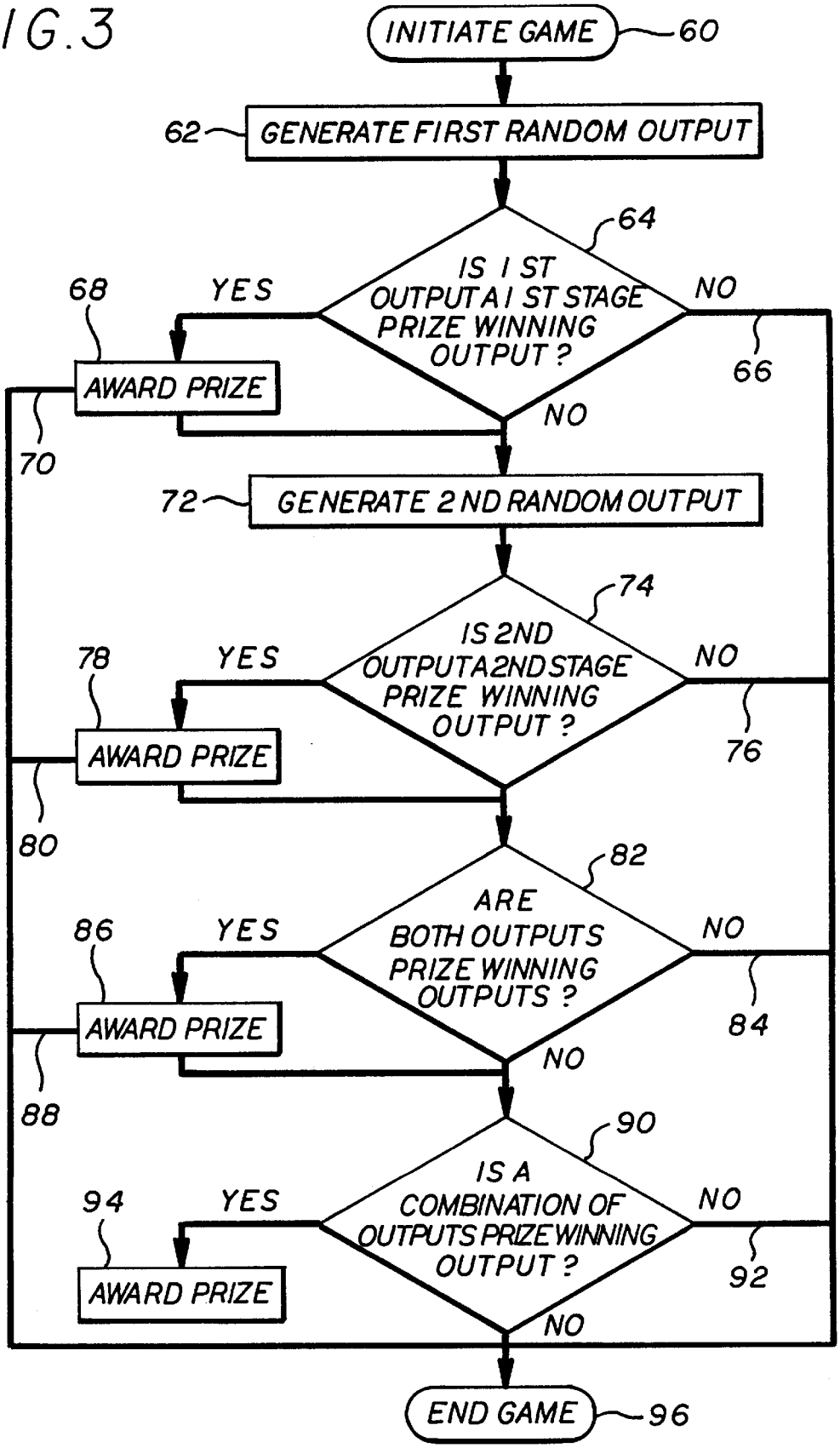
FIG. 3 is a flow chart of a second embodiment of the present invention which consecutively and independently generates the first and second random outputs.

FIG. 3 represents an embodiment of the present invention which consecutively and independently generates the first and second random outputs. The game is initiated 60 and a first random output is generated 62. The first output is then examined to determine if it is a first-stage prize winning output 64. If it is a prize winning output, a prize may be awarded 68. If the output is not a prize winning output, a second random output is generated 72.

Once the second random output is generated 72, it is examined to determine if it is a second-stage prize winning output 74. If it is a prize winning output, a prize is awarded 78. If it is not a prize winning output, both the first and second outputs are examined to determine if together they are prize winning outputs 82.

If both the first and second outputs are prize winning outputs, a prize is awarded 86. If both outputs are not prize winning outputs, no prize is awarded and a combination of outputs is examined to determine if the combination is a prize winning output 90. If the combination is a prize winning output, a prize is awarded 94. If the combination is not a prize winning output, the game would end 96.

The embodiment in FIG. 3 may also be applied to a series of games. For example, a user may play one game in which the first random output is generated 62 and examined 64. The game would then end and the user could initiate a new game. This second game would generate a new random output which would be considered the second random output 72. The first and second outputs could then be examined to determine if they qualify for a third-stage prize. The user could then initiate another game. The previous game's output would be considered the first output and the new output would be considered the second output. This consecutive game embodiment encourages the player to continue to play consecutive games and only one display device may be used.

Lines 66, 76, 84, and 92 represent alternative embodiments in which the game would immediately end if any of the inquiries were negative. Lines 70, 80, and 88 represent alternative embodiments in which the game would immediately end if a prize was awarded after any of the inquiries. One or all of these alternative embodiments may be provided to achieve desired results.

Consecutive Dependent Output Generation

Figure 4:
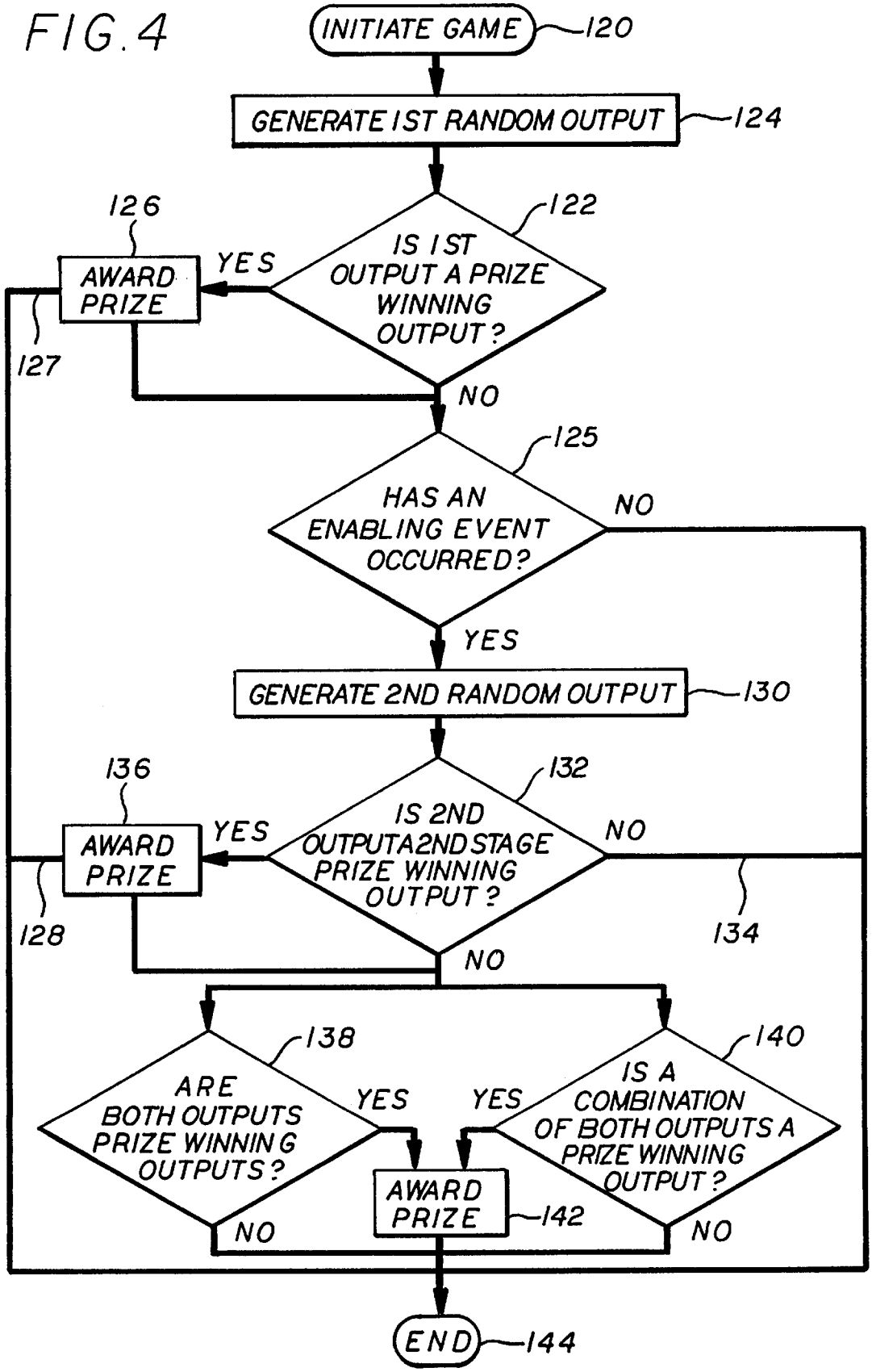
FIG. 4 is a flow chart of the third embodiment of the present invention which consecutively and dependently generates the first and second random outputs.

FIG. 4 represents a third embodiment of the present invention in which the first and second random outputs are consecutively and dependently generated. In this embodiment, the game is initiated 120 and the first random output is generated 124. The first random output is then examined to determine if it is a first-stage prize winning output 122. If it is, a prize is awarded 126. If it is not, the first output is examined to determine if an enabling event has occurred 125. An enabling event is one which would enable the generation of the second random output. If there is no enabling event, the game would immediately end 144. If an enabling output has occurred, the second random output would be generated 130. Almost any event can be an enabling event. For example, the user may be required to place an ante or additional wager to participate in the second and third stages of the game. Alternatively, an enabling event may occur when the first output is a loosing output for a predefined number of games. For example, if the player looses three consecutive games at the first-stage level, the second-stage may be enabled. An enabling decision 125 may also be placed in other parts of the method. For example, the enabling decision 125 may be placed between the second and third stages in order to enable the third-stage enquiries.

In the present embodiment, the second random output is examined to determine if it was a second-stage prize winning output 132. If it is, a prize is awarded 136. If it is not, two inquiries may be performed in parallel. The first inquiry examines both the first and second outputs to determine if they are both prize winning outputs 138. If they are, a prize is awarded 142. If they are not, the game is ended 144. The second inquiry examines a combination of both the first and second outputs to determine if the combination is a prize winning output 140. If it is, a prize is awarded 142. If it is not, the game is ended 144. As in the embodiments discussed above, these two inquiries may also be performed in series so that one of the inquiries could be bypassed.

Lines 127 and 128 represent alternative embodiments in which the game is concluded if the respective prize is awarded. Line 134 represents an alternative embodiment in which the game is concluded if the second-stage output is not a prize winning output.

Pay Tables

Various types of pay tables, which are well known in the art, may be used with the present invention. An example of a pay table which may be used with the first-stage of the present invention in a reel-type gaming device like that shown in FIG. 1 is as follows:

TABLE 1

| OUTPUT | | | |
|---|---|---|---|
| Reel 1 | Reel 2 | Reel 3 | PRIZE |
| BAR | BAR | BAR | 100 |
| BAR | X | BAR | 75 |
| X | BAR | X | 50 |

This pay table is similar to pay tables which are widely used in reel-type games. Reels 1, 2, and 3 may form a first set of reels. Different combinations of reel stop positions or symbols provide different prize values. The prizes are generally inversely proportional to the probability of occurrence of the set of symbols.

An example of a second-stage pay table which may be used with the present invention is as follows:

TABLE 2

| OUTPUT | | | |
|---|---|---|---|
| Reel 4 | Reel 5 | Reel 6 | PRIZE |
| CHERRY | CHERRY | CHERRY | 100 |
| CHERRY | GRAPE | CHERRY | 75 |
| GRAPE | CHERRY | GRAPE | 50 |

Reels 4, 5, and 6 may form a second set of reels. This pay table is very similar to the first stage pay table except different symbols and winning combinations are used.

An example of a third-stage pay table which may be used with the present invention is as follows:

TABLE 3

| OUTPUT | | | | | | |
|---|---|---|---|---|---|---|
| Reel 1 | Reel 2 | Reel 3 | Reel 4 | Reel 5 | Reel 6 | PRIZE |
| BAR | BAR | BAR | CHERRY | CHERRY | CHERRY | 10,000 |
| BAR | X | BAR | CHERRY | GRAPE | CHERRY | 5,600 |
| X | BAR | X | GRAPE | CHERRY | GRAPE | 2,500 |

This pay table incorporates the winning combinations of the first and second stages to effectively determine if both the first and second outputs are winning outputs.

An example of a pay table which utilizes partial combination of the first and second outputs is as follows:

TABLE 4

| OUTPUT | | | | |
|---|---|---|---|---|
| Reel 1 | Reel 2 | Reel 4 | Reel 5 | PRIZE |
| BAR | BAR | CHERRY | CHERRY | 6,600 |
| BAR | X | CHERRY | GRAPE | 3,600 |
| X | BAR | GRAPE | CHERRY | 1,600 |

In this pay table the winning combinations are formed by the first and second reels of each set of reels. The third reel of each set is ignored.

The symbols, combinations, and prize values of the above tables are for illustration purposes only. Many different symbols, combinations, and values may be used.

SUMMARY

It may now be realized from the above description that the present invention includes a multi-stage wagering game which may provide high prize values with a low probability of occurrence. This is achieved by comparing two or more random outputs to a predetermined prize winning output. The outputs may be generated by a means which is not capable of independently producing low probability outputs.

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A method of playing a multi-stage wagering game, the method comprising the following steps:

(A) generating a first random output;

(B) awarding a first-stage prize if the first random output is a predefined first stage output;

(C) generating a second random output independently from the first random output; and (D) awarding a third-stage prize if both the first and the second outputs are predefined prize winning outputs.

2. The method of claim 1 wherein the third-stage prize is only awarded if a predefined enabling event has occurred.

3. The method of claim 2 wherein the predefined enabling event is a player placing a second-stage wager.

4. The method of claim 2 wherein the predefined enabling event is a player activating the generation of the second random output.

5. The method of claim 1 further comprising the step of awarding a second-stage prize if the second random output is a predefined output.

6. The method of claim 1 wherein the first random output is generated in a first game and the second random output is generated in a second game.

7. A method of playing a multi-stage wagering game, the method comprising the following steps:

(A) generating a first random output;

(B) awarding a first-stage prize if the first random output is a predefined first stage output;

(C) generating a second random output; and (D) awarding a third-stage prize if a combination or partial combination of the first and the second outputs is a predefined prize winning output.

8. The method of claim 7 wherein the third-stage prize is only awarded if a predefined enabling event has occurred.

9. The method of claim 8 wherein the predefined enabling event comprises a player performing a predefined act.

10. The method of claim 8 wherein the predefined enabling event comprises a predefined first random output.

11. The method of claim 7 further comprising the step of awarding a second-stage prize if the second random output is a predefined second-stage output.

12. A method of playing a multi-stage wagering game on an electronic wagering device, the electronic wagering device having first and second display devices for displaying randomly generated outputs, the method comprising the following steps:

(A) generating a first random output;

(B) displaying the first random output on the first display device;

(C) awarding a first-stage prize if the first random output is a predefined first stage output;

(D) generating a second random output independently from the first random output;

(E) displaying the second random output; and (F) awarding a third-stage prize if the first and second outputs are predefined prize winning outputs.

13. The method of claim 12 wherein the second random output is only displayed and the third-stage prize is only awarded if a predefined enabling event has occurred.

14. The method of claim 13 wherein the predefined enabling event comprises a player performing a predefined act.

15. The method of claim 13 wherein the predefined enabling event is a predefined first-stage output.

16. The method of claim 13 further comprising the step of awarding a second-stage prize if the second random output is a predefined second-stage output.

17. A method of playing a multi-stage wagering game on an electronic wagering device, the electronic wagering device having first and second display devices for displaying randomly generated outputs, the method comprising the following steps:

(A) generating a first random output;

(B) displaying the first random output on the first display device;

(C) awarding a first-stage prize if the first random output is a predefined first-stage output;

(D) generating a second random output; and (E) awarding a third-stage prize if a combination or partial combination of the first and second outputs is a predefined prize winning output.

18. The method of claim 17 wherein the second output is only displayed and the third-stage prize is only awarded if a predefined enabling event has occurred.

19. The method of claim 18 wherein the predefined enabling event comprises a player placing a second-stage wager.

20. The method of claim 18 wherein the predefined enabling event comprises a player activating the generation of the second-stage output.

21. The method of claim 18 wherein the predefined enabling event is a predefined first-stage output.

22. The method of claim 17 further comprising the step of awarding a second-stage prize if the second random output is a predefined second-stage output.

* * * * *